US006978908B2

(12) United States Patent
Morano et al.

(10) Patent No.: US 6,978,908 B2
(45) **Date of Patent: *Dec. 27, 2005**

(54) DRINKING VESSEL WITH ADJUSTABLE HANDLES

(75) Inventors: Emanuel P. Morano, Totowa, NJ (US); Daniel J. Nelsen, Providence, RI (US)

(73) Assignee: Gerber Products Company, Freemont, MI (US)

( * ) Notice: Subject to any disclaimer, the term of this patent is extended or adjusted under 35 U.S.C. 154(b) by 36 days.

This patent is subject to a terminal disclaimer.

(21) Appl. No.: 10/689,009

(22) Filed: Oct. 20, 2003

(65) Prior Publication Data

US 2005/0056614 A1 Mar. 17, 2005

Related U.S. Application Data

(63) Continuation-in-part of application No. 10/662,679, filed on Sep. 15, 2003.

(51) Int. Cl.[7] ..... A61J 9/00; A61J 9/08; A61J 11/00; B65D 23/10

(52) U.S. Cl. ..... 215/396; 215/11.1; 220/764; 220/772

(58) Field of Search ..... 215/11.1, 396, 215/398; 220/757–759, 753, 762, 764, 772; 294/31.2

(56) References Cited

U.S. PATENT DOCUMENTS

| | | | | | |
|---|---|---|---|---|---|
| 2,365,947 | A | * | 12/1944 | Ganson | 215/11.5 |
| 2,434,611 | A | * | 1/1948 | Hamiel | 215/11.5 |
| 2,789,002 | A | | 7/1954 | Nicholas | |
| 2,746,631 | A | * | 5/1956 | Witz | 215/11.1 |
| 2,796,188 | A | | 6/1957 | Kurkijian | |
| 2,889,064 | A | * | 6/1959 | Kurkjian | 215/11.1 |
| 2,986,296 | A | * | 5/1961 | Bannister et al. | 215/11.1 |
| 3,101,857 | A | * | 8/1963 | Freedman | 215/396 |
| 3,532,242 | A | * | 10/1970 | Tibbs | 215/11.1 |
| 3,990,596 | A | | 11/1976 | Hoftman | 215/396 X |
| 4,497,417 | A | * | 2/1985 | Tabet | 220/772 |
| 4,548,157 | A | | 10/1985 | Hevoyan | |
| 4,557,392 | A | | 12/1985 | Ryan et al. | |
| 4,943,017 | A | | 7/1990 | Ennis | 215/11.1 |
| 5,038,948 | A | | 8/1991 | Signorini | 215/396 X |
| D341,892 | S | | 11/1993 | Yagi | |
| 5,480,043 | A | | 1/1996 | Wingo | 215/11.1 |
| D368,529 | S | | 4/1996 | Allegre | |
| D370,262 | S | | 5/1996 | Allegre | |
| 5,692,630 | A | | 12/1997 | Hsu | 215/396 |
| 5,799,811 | A | | 9/1998 | Brückner et al. | |
| D421,878 | S | | 3/2000 | Roehrig | |

(Continued)

FOREIGN PATENT DOCUMENTS

| | | |
|---|---|---|
| EP | 0 555 165 | 8/1993 |

(Continued)

OTHER PUBLICATIONS

International Search Report.

(Continued)

*Primary Examiner*—Sue A. Weaver
(74) *Attorney, Agent, or Firm*—John W. Kung

(57) ABSTRACT

A drinking vessel with adjustable handles for a juvenile is disclosed. The drinking vessel features two handles that can be adjusted apart from each other at varying fixed or articulated angles. Furthermore, the two handles can be adjusted without the intervention of a person disassembling the drinking vessel in order to reorient or readjust the handles. The adjustable handles allow the juvenile to manipulate and hold the drinking vessels with greater flexibility.

15 Claims, 8 Drawing Sheets

U.S. PATENT DOCUMENTS

| | | | | |
|---|---|---|---|---|
| 6,037,872 | A | 3/2000 | Dunnum | 340/586 |
| D425,994 | S | 5/2000 | Hakim | |
| 6,073,788 | A * | 6/2000 | Stroud | 215/11.1 |
| D433,143 | S | 10/2000 | Chomik et al. | |
| D442,435 | S | 5/2001 | Takagi | |
| 6,286,697 | B1 | 9/2001 | Gasparini | |
| 6,325,237 | B1 | 12/2001 | Gish | 220/737 |
| D454,642 | S | 3/2002 | Hakim | |
| D476,849 | S | 7/2003 | Randolph | D7/510 |
| D495,558 | S | 9/2004 | Tollman | |
| D504,049 | S | 4/2005 | Morano et al. | |
| 2001/0027956 | A1 | 10/2001 | Bonacorso et al. | |
| 2003/0141268 | A1 | 7/2003 | Kerns et al. | 215/11.1 |

FOREIGN PATENT DOCUMENTS

| | | |
|---|---|---|
| FR | 2 715 062 | 7/1995 |

OTHER PUBLICATIONS

English Language Abstract for FR 2 715 062 from EPO, Jul. 21, 1995.

English abstract for EP555165 from EPO, Aug. 11, 1993. Machine Translation of IP555165 via babelfish.altavista.com.

* cited by examiner

DRINKING VESSEL WITH ADJUSTABLE HANDLES

RELATED APPLICATION

This is a continuation-in-part of application Ser. No. 10/662,679, filed Sep. 15, 2003.

FIELD OF THE INVENTION

The present invention relates to drinking vessels with adjustable handles and in particular to drinking vessels for use juveniles such as infants, toddlers and children.

BACKGROUND OF THE INVENTION

Before using conventional drinking cups, most infants and children drink from vessels designed specifically for their use, for example, nursers and spill proof cups. To facilitate grasping many of these nursers and spill proof cups have at least one, and more often two handles, permanently affixed to opposite sides of the vessel. When the child holds a handled vessel, her hands are positioned 180° apart. This 180° orientation always causes the hands to be placed at the furthest possible distance between them. Having the hands in this orientation is not always the most comfortable or optimal position for the child. Sometimes it is desirable to have the hands oriented at a different angle, for example, 90°. Having the hands closer together may help facilitate the holding of the vessel.

Although some prior art drinking vessels have adjustable handles, such prior art drinking vessels do not allow the handles to remain fixed once they have been adjusted to a desired setting. For example, the handles of such prior art drinking vessels will undesirably change position when the vessel is dropped onto the floor. Other prior art drinking vessels with locking handles only allow the handles to be readjusted if the entire drinking vessel were disassembled. Thus, there is a need for drinking vessels with adjustable handles that remain locked after the handles have been properly oriented and that can be easily readjusted, if needed, without resorting to disassembling the entire drinking vessel.

SUMMARY OF THE INVENTION

One aspect of the present invention is a drinking vessel that includes a mouth interface, a first handled section, a second handled section and a container assembled together. Projecting radially from the collars of each handled section are handles for grasping by a juvenile. Each handled section is rotatable at fixed angles with respect to the longitudinal axis of the container. The handles can be spaced apart at multiple fixed angles ranging from 0° to 360°. The mouth interface, for example, a nipple or spout, is inserted through and removably attached to the first handled section.

In another aspect of the present invention, the second handled section connects to the first handled section. The first handled section has threads on its inner surface that allows the first handled section to screw onto threads located on the container, thereby securing the assembly of the drinking vessel as well as securing the second handled section in place. The handles of the drinking vessel can be readjusted without the need to completely disengage the threads of the first handled section from that of the container.

In yet another aspect of the present invention, the first handled section includes a guide channel and snap grooves whereas the second handled section includes guide ribs and snap tabs. The guide ribs and snap tabs of the second handled section are received within the guide channel and snap grooves of the first handled section respectively. The guide ribs and guide channel allow the first handled section to be slidingly adjusted with respect to the second handled section when the first handled section is not completely screwed down. The snap tabs and snap groove allows the second handled section to articulate at specific angles with respect to the first handled section.

In another aspect of the present invention, a spout and first handled section include corresponding engaging alignment structures that cause the spout to remain oriented in the same position relative to the first handled section no matter how the adjustable handles are oriented. Furthermore the alignment structures cause the spout to remain in the same position when the adjustable handles are being oriented.

These and other features, advantages and objects of the present invention will be further understood and appreciated by those skilled in the art by references to the following specification, claims and appended drawings.

BRIEF DESCRIPTION OF THE DRAWINGS

The accompanying drawings, which are incorporated in and constitute a part of the specification, illustrate an exemplary embodiment of the present invention.

DETAILED DESCRIPTION OF THE INVENTION

The present invention features a drinking vessel with articulating, or adjustable, handles. The drinking vessel is appropriate for delivering potable fluids, such as milk, medicine or juice, to a juvenile such as an infant, toddler or child. Such potable fluids can be administered to the child by the mother or the child herself. Additionally, the drinking vessel is appropriate for use by an individual with impaired manual dexterity.

Figure 1:
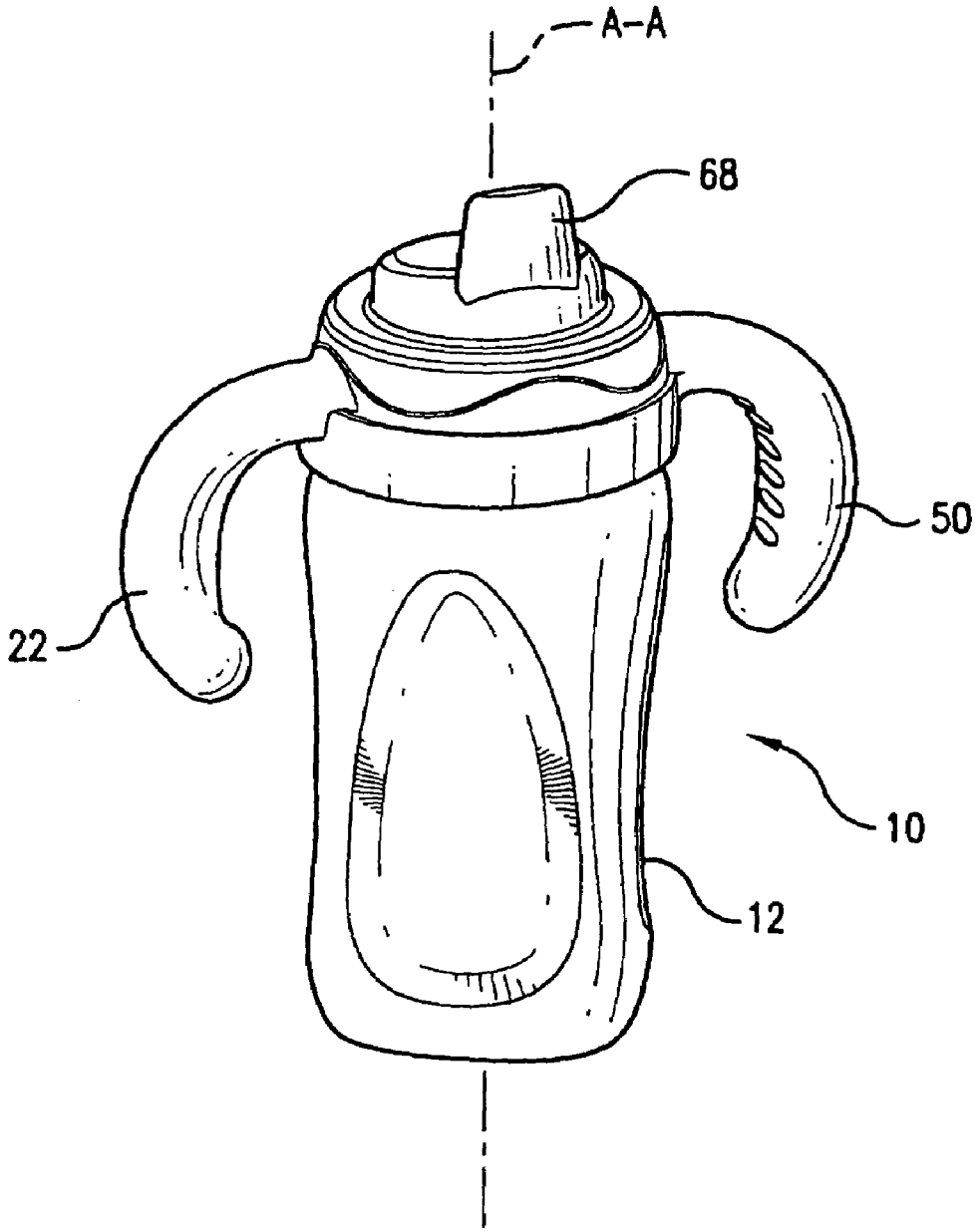
FIG. 1 shows a perspective view of a drinking vessel in accordance with an exemplary embodiment of the present invention.
Figure 2:
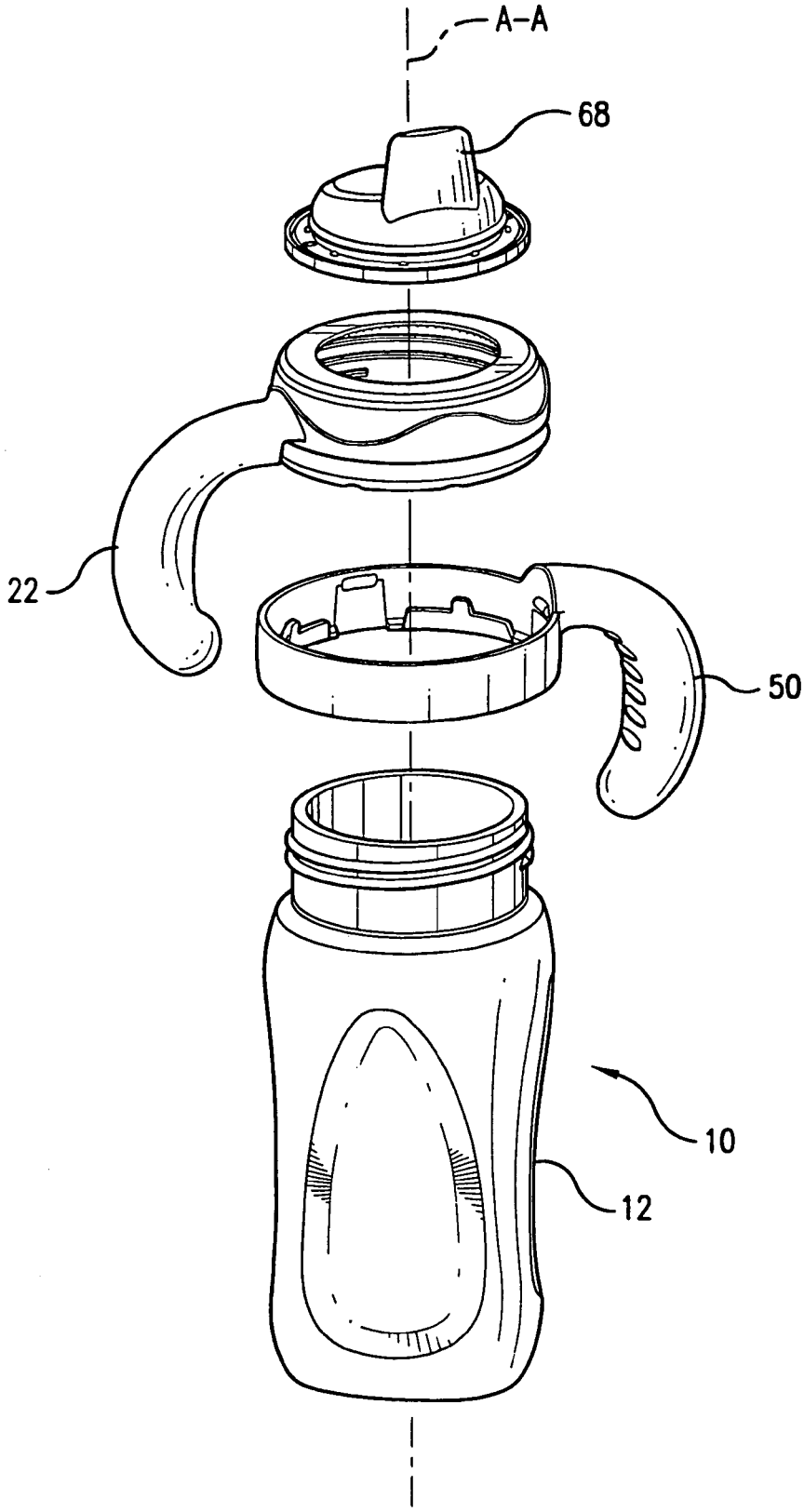
FIG. 2 is an exploded perspective view of the drinking vessel of FIG. 1.
Figure 3:
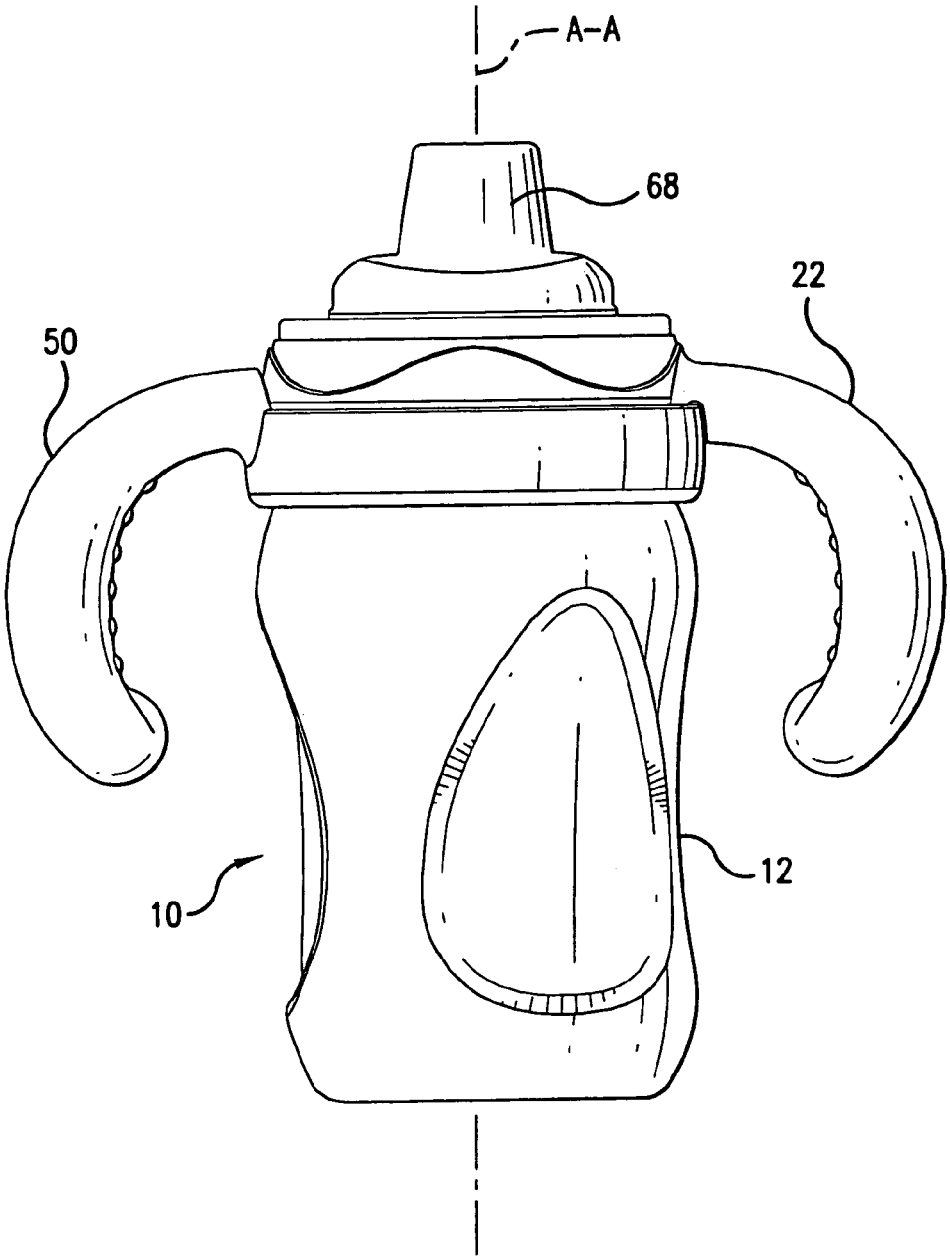
FIG. 3 is a front elevational view of the drinking vessel of FIG. 1.

FIGS. 1–3 show perspective, exploded perspective and front elevational views respectively of a drinking vessel 10 with articulating or adjustable handles in accordance with an exemplary embodiment of the present invention. FIGS. 1 and 2 show assembled and exploded perspective views respectively of the drinking vessel 10 which includes a container 12, a first handled section 22, a second handled section 50 and a mouth interface 68. The first handled section 22 and the second handled section 50 cooperate together to function, among other aspects, as the adjustable handles of the drinking vessel 10.

Figure 4:
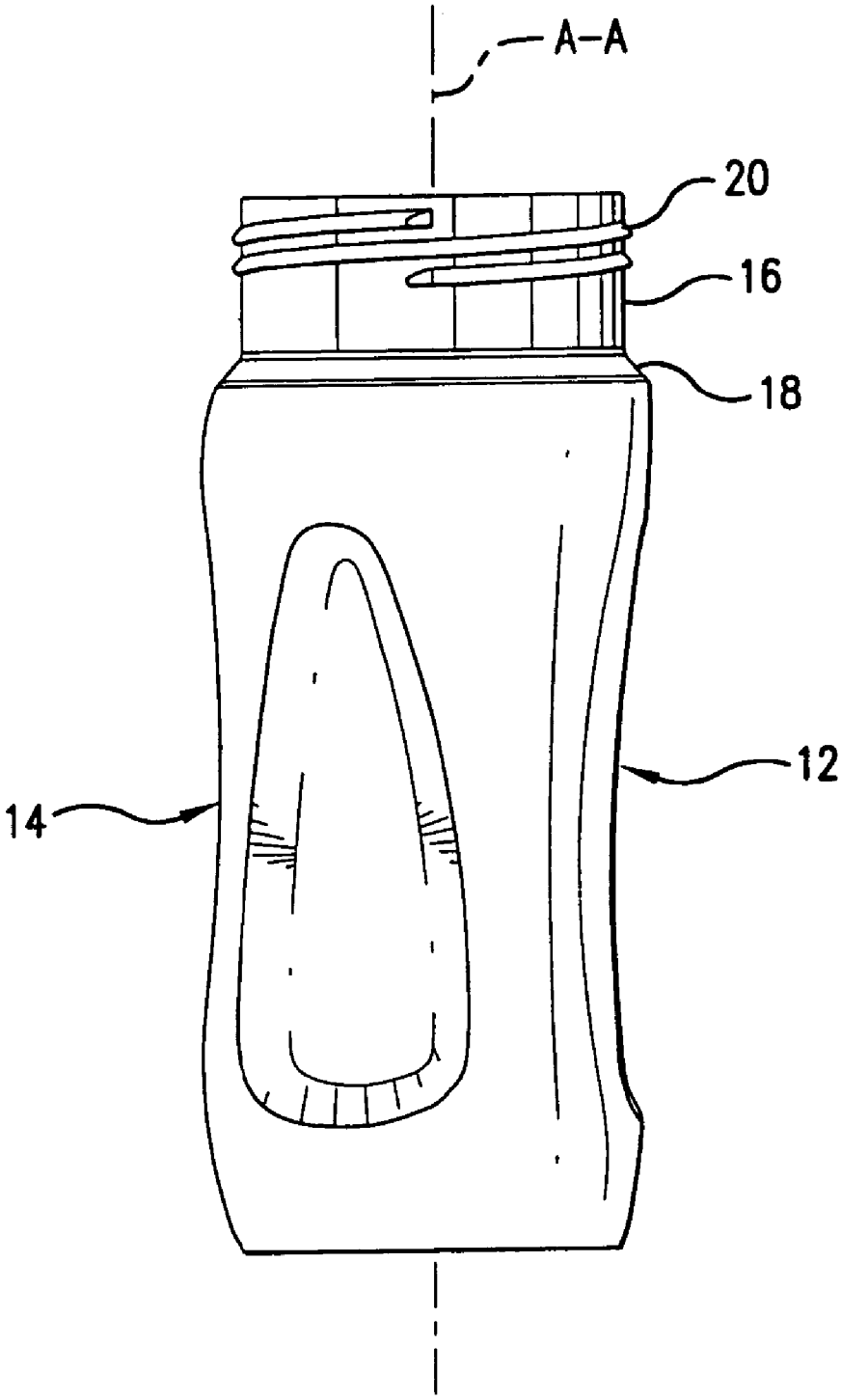
FIG. 4 is a side elevational view of the container of the drinking vessel of FIG. 1.

Referring to FIG. 4, the container 12 has a side wall 14, for example cylindrically-shaped or triangularly-shaped, extending longitudinally, along a central longitudinal axis A—A. At the top end of the side wall 14 is a neck 16 that is joined by a shoulder 18 to the container 12. The outer periphery of the neck 16 has an outer thread 20 formed thereon. The outer thread 20 allows the container 12 to be releasably connected to the corresponding inner thread 44 of the first handled section 22 which is described in more detail below.

Figure 5:
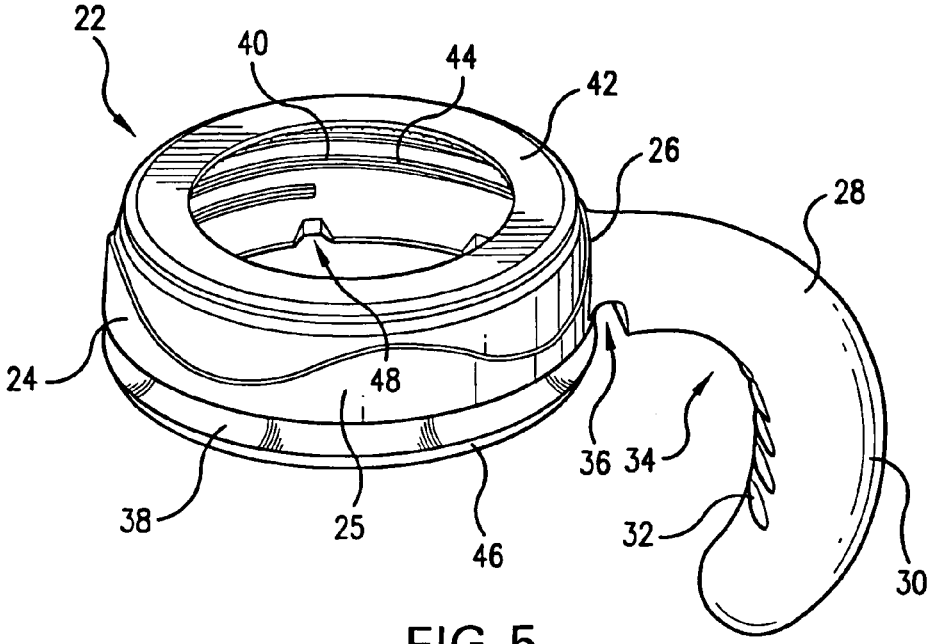
FIG. 5 is a top perspective view of the first handled section of the drinking vessel of FIG.1.
Figure 6:
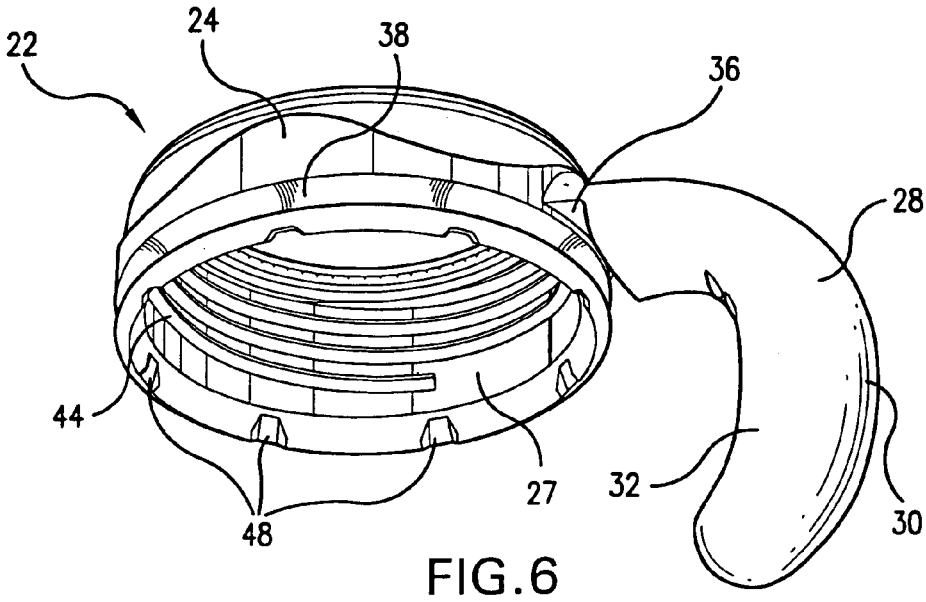
FIG. 6 is a bottom perspective view of the first handled section of the drinking vessel of FIG. 1.

Referring to FIGS. 5 and 6, the first handled section 22 includes a generally circular first collar 24. Projecting radially from the outer surface 25 of the first collar 24 at a first junction 26 is a first handle 28. The first handle 28 is sized and shaped to be a smooth and continuous contour with no sharp edges. For example, the first handle 28 has an outer convex surface 30 and an inner concave surface 32. Located at or near the first junction 26 is a gap 36 that prevents the inner concave surface 32 from being contiguous with the outer surface of the first collar 24. The gap 36 should be of sufficient width to accommodate a top rim 62 of the second handled section 50 as described in more detail below. Furthermore, the gap 36 should, for example, be no greater in depth than half of the maximum thickness of the first handle 28. Any larger depth for the gap 36 could render the first handle 28 easily broken or detached from the first collar 24.

Both the first handle 28 and the first collar 24 can be integrally molded from the same type of material, for example, a non-toxic polymer suitable for drinking vessels as known in the art. This also applies to second handle 56 and the second collar 52 which are described in detail below. Examples of suitable polymers include, but are not limited to, polypropylene, polyethylene, polycarbonate, polystyrene, polyethylene terephthalate, polyester, copolyester, and acrylonitrile-butadiene-styrene. Additionally, an elastomeric polymer 34, such as SANTOPRENE, available from Advanced Elastomer Systems (Akron, Ohio) or KRATON, a styrene-butadiene elastomer from Shell Oil Company (Houston, Tex.) can be overmolded on or onto the handles to provide a gripping surface for improved grasping. Optionally, molded on or onto the handles are a plurality of protuberances which are present to aid grasping by the juvenile. The protuberances, for example, can be concentric rings or ridges or a plurality of discrete bumps.

At the bottom end of the outer surface 25 of the first collar 24 is a guide channel 38 that extends along the entire circumference of the bottom end.

At the top end of the first collar 24 is an opening 40 defined by an in-turned top flange 42. A mouth interface 68 (as shown in FIG. 1), for example, a nipple or spout as known by one of ordinary skill in the art, is removably inserted through the bottom of the first handled section 22 through the opening 40 and held in place by the flange 42. The mouth interface 68 allows the potable liquid to flow therethrough from the container 12 to the mouth of the juvenile. The mouth interface 68 directly contacts the juvenile's mouth.

Located on the inner surface 27 of the first collar 24 is inner thread 44 which is configured to be removably engaged with the outer thread 20 located on the neck 16 of the container 12. Such engagement, for example, can be implemented by screwing the first handled section 22 in a clockwise fashion onto the neck 16 of the container 12.

Periodically spaced at, near, or on the bottom rim 46 of the first handled section 22 are a plurality of snap grooves 48. These snap grooves 48 are used to releasably engage the corresponding snap tabs 66 on the second handled section 50 described in more detail below. The bottom rim 46 has at least, for example, three snap grooves. The greater the number of snap grooves 48, the greater the adjustability of the first handle 28 and a second handle 56. For example, the bottom rim 46 has eight snap grooves 48 each angularly spaced 45° apart from the next snap groove. This configuration of snap grooves 48 allows the first handle 28 and the second handle 56 to be angularly spaced at 45° intervals, for example 45°, 90°, 135°, 180°, 225°, 270°, 315° and 360° angles. Thus, any number and any angle of spacing can be used to configure the snap grooves 48.

Figure 7:
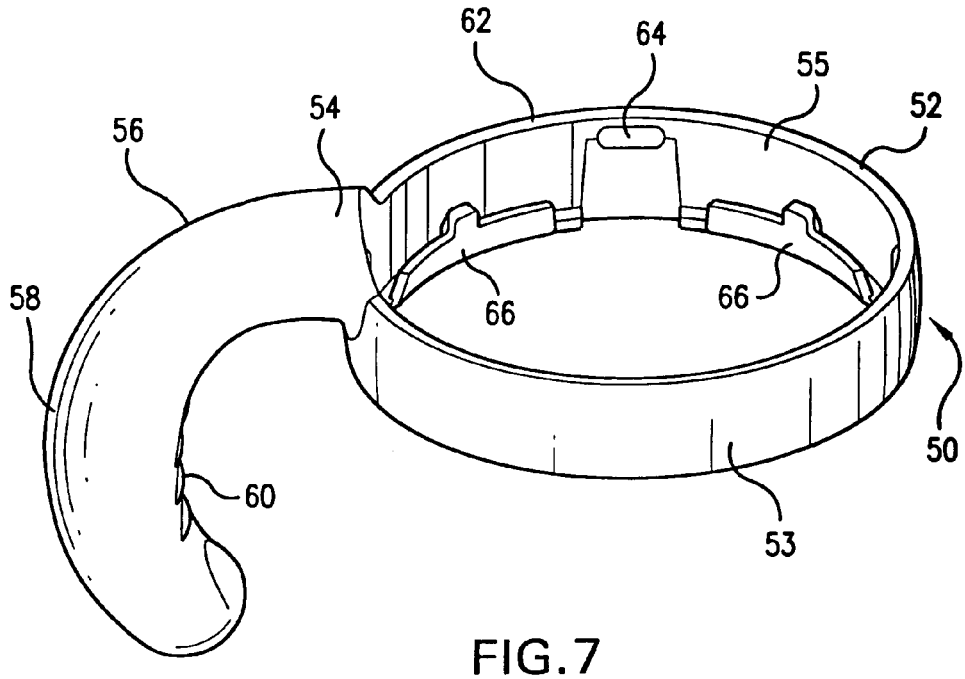
FIG. 7 is a top perspective view of the second handled section of the drinking vessel of FIG. 1.
Figure 8:
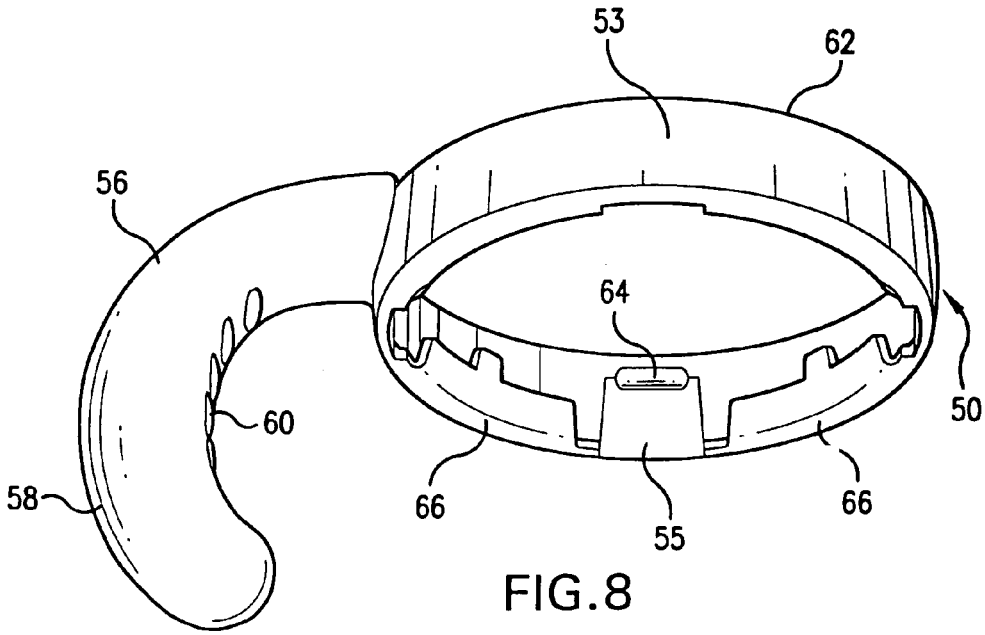
FIG. 8 is a bottom perspective view of the second handled section of the drinking vessel of FIG. 1.

Referring to FIGS. 7 to 8, the second handled section 50 also includes a generally circular collar 52. As with the first handled section 22, the outer surface 53 of the second collar 52 intersects with the second handle 56 at a second junction 54. The dimensions of the second handle 56 is the same, or nearly same, as that of the first handle 28. However, the placement of the second handle 56 at second junction 54 is not, for example, identical to the placement of the first handle 28 at first junction 26. The principal differences are that the outer convex surface 58 of the second handle 56 is not contiguous with the outer surface 53 of the second collar 52 whereas an inner concave surface 60 of the second handle 56 is contiguous with the outer surface of the second collar 52. Furthermore, there is no gap between the second handle 56 and the second collar 52 as there is in the first handled section 22. The top of the second handle 56 is not flush with and higher than the top rim 62 of the second handled section 50.

Located near the top end of the inner surface 55 of the second collar 52 of the second handled section 50 is a plurality of guide ribs 64. These guide ribs 64 are sized such that they are slidingly received within the guide channel 38 of the first handled section 22 when the second handled section 50 is attached to the first handled section 22. When the two handled sections 22, 50 are attached, for example by a snap-fit, friction fit, press fit or interference fit, the guide ribs 64 in the guide channel 38 keep the two handled sections 22, 50 engaged together. However, the fit between the guide ribs 64 and the guide channel 38 is not so tight that the two handled sections 22, 50 are unable to freely rotate with respect to each other about the longitudinal axis A—A.

Protruding inwardly from the inner surface of the bottom end of the second handled section 50 are a plurality of snap tabs 66. The number of snap tabs 66 are, for example, equal to or less than the number of snap grooves 48. Additionally, the snap tabs 66, for example, have compatible dimensions such that each snap tab 66 and its corresponding snap groove 48 form a complementary snap-fit.

Figure 9:
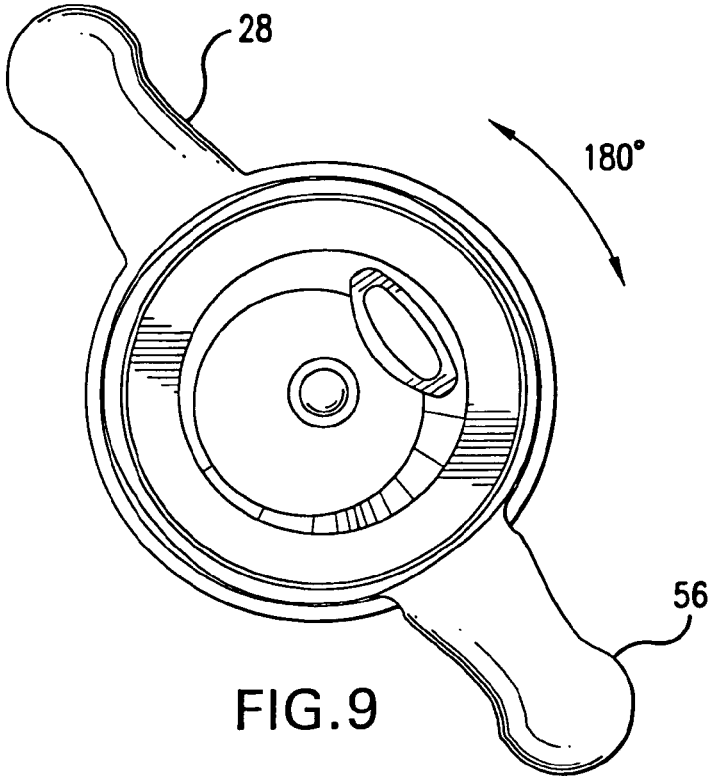
FIG. 9 is a top plan view of the drinking vessel of FIG. 1 with the handles spaced oriented 180° apart.

When assembled, as shown in FIGS. 1 and 3, the second handled section 50 is connected between the first handled section 22 and neck 16 of the container 12. The inner thread 44 of the first handled section 22 engages the outer thread 20 of the neck 16. Furthermore, the guide ribs 64 are received in the guide channel 38, and the snap tabs 66 are received in the snap grooves 48. Moreover, the top rim 62 of the second handled section 50, for example, is received in the gap 36 of the first handled section 22; this allows the first handle 28 to be horizontally aligned with the second handle 56 with respect to the longitudinal axis A—A. For example, FIG. 9, a top plan view of the drinking vessel 10, shows the assembled drinking vessel with the first handle 28 and the second handle 56 oriented 180° apart.

As the handled sections 22, 50 are screwed down, for example, in a clockwise fashion, onto the neck 16 of the container 12, the second collar 52 contacts the neck 16 thereby stopping the vertical travel of the second handled section 50. As the first handled section 22 is being screwed down, the two handled sections 22, 50 are locked, or fixed, into a desired position. The first handled section 22 seals and secures the mouth interface 68 onto the container 12 thereby providing a leak-proof and secure system. The mouth interface 68, for example, serves as the final stop for the first collar 24 while the neck 16 of the container 12, for example serves as the final stop for the second collar 52. When the first handled section 22 is no longer freely rotatable with respect to the second handled section 50 and thus the first handle 28 and second handle 56 are locked into position.

Figure 10:
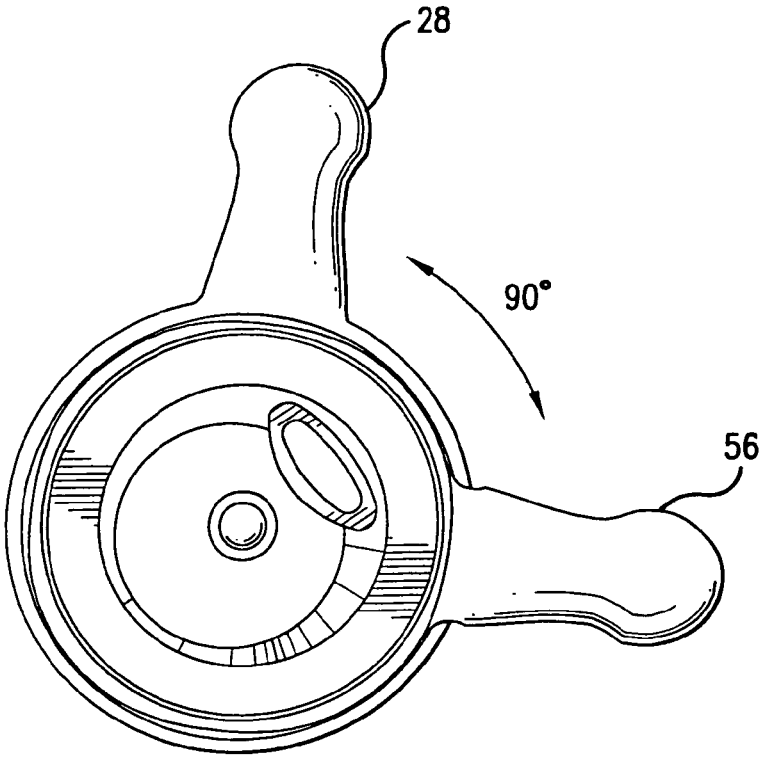
FIG. 10 is a top plan view of the drinking vessel of FIG. 1 with the handles spaced 90° apart.

To adjust the handles 28, 56 into a different position, the first handled section 22 is, for example, rotated, or unscrewed, in a counterclockwise fashion until the first handled section 22 and the second handled section 50 are freely rotatable, but not necessarily completely disengaged (i.e., disassembled) from the container 12, with respect to each other. The first handle 28 and the second handle 56 are then rotated to the desired position such that the snap tabs 66 index into corresponding snap grooves 48. For example, FIG. 10, another top plan view of the drinking vessel 10, shows the first handle 28 and the second handle 56 oriented 90° apart. The positions of the handles 28, 56 can be repeatedly readjusted without the need to completely disassemble or separate the first handled section 22 from the second handled section 50. This feature provides an advantage over other adjustable handle drinking vessels because the entire drinking vessel does not have to be disassembled in order to change the positions of the handles, thus reducing the potential for any leaks or spills when the handles are being adjusted or readjusted and making the feeding task more convenient for the caregiver. Moreover, because juveniles lack the manual dexterity to unscrew the handled sections 22, 50 from the container 12, the juveniles cannot move or change the position of the handles 28, 56.

Moreover, once the first handled section 22 and the second handled section 50 are set into a desired angle or position, they can be removed as a single unit from the container 12 and remain locked together in such desired angle. For example, if a caregiver sets the angle between the first handled section 22 and the second handled section 50 at 135°, the container 12 can be removed from the handled sections 22, 50, while the first handled section 22 and second handled section 50 remain locked together at 135°.

When the mouth interface 68 used in the drinking vessel 10 is asymmetric, it is desirable for the for the mouth interface 68 and the first handled section 22 to have alignment structures that allows the mouth interface 68 to remain in the same position with respect to the first handled section 22 as the handled sections 22, 50 are being rotated or adjusted. As used herein, the term "asymmetric" when applied to a mouth interface 68 means that a mouth interface 68 must be oriented in a particular configuration in the mouth of a juvenile in order for the juvenile to properly and comfortably drink from the drinking vessel 10. For example, an orthodontic nipple or spout are asymmetric since each has to be inserted in a certain orientation when placed in the mouth of a juvenile. Without such alignment structures, a caregiver would have to reorient or reposition the mouth interface 68 each time the handled sections 22, 50 are re-adjusted. Since the components of the drinking vessel 10 are assembled, for example, by screwing them together friction between the mouth interface 68 and the top surface of the flange 42 of the first handled section 22 causes the mouth interface 68 to remain fixed in position as the first handled section 22 is being re-adjusted.

Figure 11:
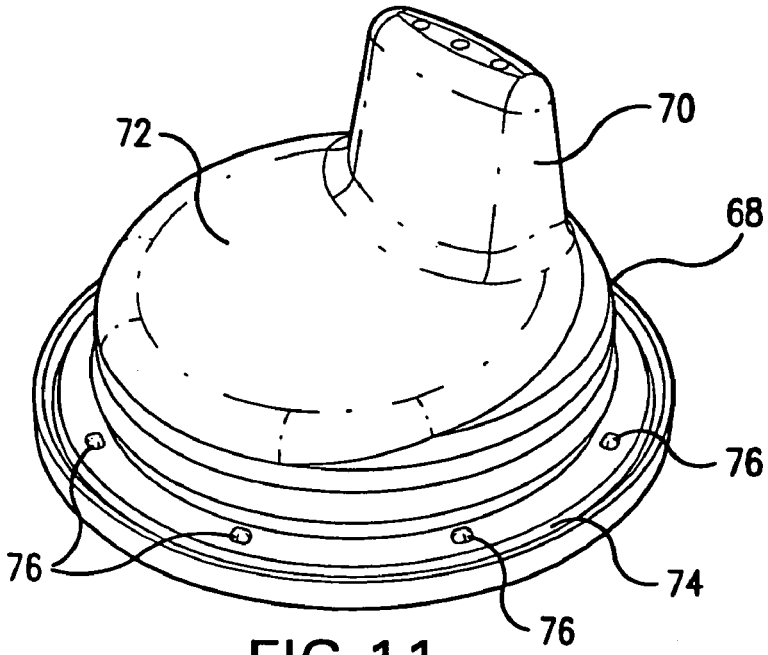
FIG. 11 is a perspective view of an exemplary mouth interface that is compatible with the drinking vessel of FIG. 1.

FIG. 11 shows a perspective view of an exemplary mouth interface 68 that has an alignment structure. For example mouth interface 68 has a spout portion 70, a bulbous portion 72 and a rim 74. The rim 74 resides on the bottom perimeter of the bulbous portion 72 and extends outwardly from the bulbous portion 72. The spout portion 70 extends upwardly from the bulbous portion 72 and is sized to fit in the mouth of a juvenile as known by one of ordinary skill in the art. On the top side of the rim 74, towards the spout portion 70, are a plurality of nubs 76 that extend upwardly from the surface of the rim 74. The plurality of nubs 76, can be evenly or unevenly spaced along the rim 74. For example, the rim 74 should have at least one nub 76, or alternatively from four to twelve nubs. Alternatively, if the mouth interface 68 is an orthodontic nipple, then the spout portion 70 can be replaced by a stem portion.

Figure 12:
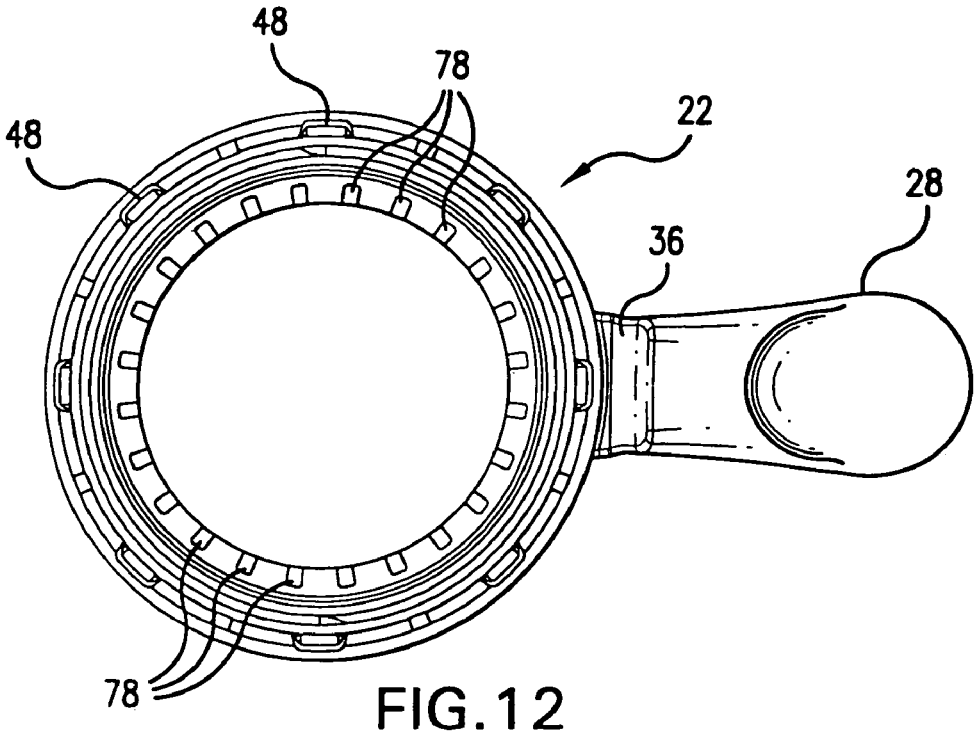
FIG. 12 is a bottom plan view of a first handled section that is suitable for engaging the exemplary mouth interface shown in FIG. 11

FIG. 12 shows a bottom plan view of the fist handed section 22 that also has an alignment structure. Located along the bottom side of flange 42 towards the second handled section 50 is a plurality of detents 78. The plurality of detents 78 can be evenly or unevenly spaced along the flange 42. The flange 78 should have at least one detent 78. For example, the number of detents 78 should be greater than the number of nubs 76 on the rim 74 of the mouth interface 68. Furthermore, the detents 78 are designed such that the nubs 78 are removably received within them. Thus, the size and shape of the detents 78 and nubs 76 correspond with each other such that they engage with each other. As shown in FIGS. 11 and 12, the exemplary nubs 76 and detents 78 shown have a male/female engagement with the nubs 76 being the male portion and the detents 78 being the female portion.

When the mouth interface 68 is assembled with the first handled section 22, the nubs 76 of the mouth interface 68 engage with the detents 78. As the first handled section 22, the engagement of the nubs 76 to detents 78 causes the mouth interface to rotate as the first handled section 22 is rotated. This alignment mechanism ensures that whatever position the caregiver originally has the mouth interface 68 in relation to the first handled section 22 remains even if the first handled section 22 and/or second handed section 50 are being readjusted or re-oriented.

It is understood that while the present invention has been described in conjunction with the detailed description thereof that the foregoing description is intended to illustrate and not limit the scope of the invention, which is defined by the scope of the following claims. Other aspects, advantages and modifications are within the scope of the claims.

What is claimed:

1. A drinking vessel, comprising:

a) a mouth interface for delivering a potable liquid, said mouth interface having an alignment mechanism;

b) a first handled section, said first handled section having a first handle projecting radially from a first outer surface of a first collar, said first collar having an opening to receive said mouth interface;

c) a second handled section, said second handled section having a second handle projecting radially from a second outer surface of a second collar and being removably connected to said first handled section;

d) a container for holding a potable liquid, said container having a longitudinal axis and being removably connected to said first handled section; and wherein said first handle and second handle are adjustable to be oriented at a fixed angle and said mouth interface remains in a single orientation with respect to said first handled section as said first handle and second handle are adjusted, and wherein a condition i) is present, a condition ii) is present, or conditions i) and ii) are present, wherein conditions i) and ii) are i) the first handle and second handle are adjustable to a plurality of fixed angles with respect to said axis, and the fixed angle is chosen from 45°, 90°, 135°, 180°, 225°, 270°, 315° and 360°, ii) the first handled section has a bottom rim extending inwardly from the first collar and having a plurality of snap grooves, the second handled section has a bottom end that has a plurality of snap tabs, wherein the snap tabs releasably engage the snap grooves.

2. The drinking vessel of claim 1, wherein said first handle and second handle are adjustable with respect to said axis without said first handled section being disassembled from said container.

3. The drinking vessel of claim 1, wherein when condition i) is not present, said first handle and second handle are adjustable to a plurality of fixed angles with respect to said axis.

4. The drinking vessel of claim 1, wherein condition i) is present but condition ii) is not present.

5. The drinking vessel of claim 1, wherein said mouth interface is chosen from a nipple and a spout.

6. The drinking vessel of claim 1, wherein said first handle and said second handle are covered by an elastomer.

7. The drinking vessel of claim 1, wherein condition ii) is present but condition i) is not present.

8. The drinking vessel of claim 1, wherein condition i) and condition ii) are present.

9. A drinking vessel, comprising:

a) a mouth interface for delivering a potable liquid, said mouth interface having a rim extending outwardly and a plurality of nubs on said rim;

b) a first handled section, said first handled section having a first handle projecting radially from a first outer surface of a first collar, said first collar having an opening to receive said mouth interface, said first handled section having a flange extending inwardly from said first collar and having a plurality of detents on said flange;

c) a second handled section, said second handled section having a second handle projecting radially from a second outer surface of a second collar and being removably connected to said first handled section;

d) a container for holding a potable liquid, said container having a longitudinal axis and being removably connected to said first handled section; and wherein said first handle and second handle are adjustable to be oriented at a fixed angle and said nubs engage with said detents, and wherein a condition i) is present, a condition ii) is present, or conditions i) and ii) are present, wherein conditions i) and ii) are i) the first handle and second handle are adjustable to a plurality of fixed angles with respect to said axis, and the fixed angle is chosen from 45°, 90°, 135°, 180°, 225°, 270°, 315° and 360°, ii) the first handled section has a bottom rim extending inwardly from the first collar and having a plurality of snap grooves, the second handled section has a bottom end that has a plurality of snap tabs, wherein the snap tabs releasably engage the snap grooves.

10. The drinking vessel of claim 9, wherein said first handle and second handle are adjustable with respect to said axis without said first handled section being disassembled from said container.

11. The drinking vessel of claim 9, wherein when condition i) is not present, said first handle and second handle are adjustable to a plurality of fixed angles with respect to said axis.

12. The drinking vessel of claim 9, wherein condition i) is present but condition ii) is not present.

13. The drinking vessel of claim 9, wherein said mouth interface is chosen from a nipple and a spout.

14. The drinking vessel of claim 9, wherein condition ii) is present but condition i) is not present.

15. The drinking vessel of claim 9, wherein condition i) and condition ii) are present.

* * * * *